United States Patent [19]

Kwok

[11] Patent Number: 4,755,135

[45] Date of Patent: Jul. 5, 1988

[54] CANDLE DEVICE

[76] Inventor: Wai-Shi Kwok, Metropole Building, Block C, 25th Floor, Room 26, 7 King's Road, North Point, Hong Kong

[21] Appl. No.: 931,834

[22] Filed: Nov. 18, 1986

[30] Foreign Application Priority Data

Nov. 19, 1985 [GB] United Kingdom ..... 8528452
Apr. 16, 1986 [GB] United Kingdom ..... 8609261

[51] Int. Cl.[4] ..... F23D 3/16

[52] U.S. Cl. ..... 431/290; 431/126; 431/253; 431/291; 431/292

[58] Field of Search ..... 431/35, 126, 288, 289, 431/290, 291, 292, 294, 253, 320

[56] References Cited

U.S. PATENT DOCUMENTS

| | | | |
|---|---|---|---|
| 47,207 | 4/1865 | Houchin | 431/289 |
| 2,680,963 | 6/1954 | Churchill | 431/290 |
| 2,730,884 | 1/1956 | Cozzoli | 431/290 |
| 3,121,316 | 2/1964 | Wilson et al. | 431/290 |
| 3,586,473 | 6/1971 | Galloway | 431/126 X |
| 3,604,825 | 9/1971 | Leshko | 431/290 |
| 4,477,249 | 10/1984 | Ruzek et al. | 431/253 |

FOREIGN PATENT DOCUMENTS

| | | | |
|---|---|---|---|
| 85202044 | 12/1985 | China . | |
| 301542 | 3/1917 | Fed. Rep. of Germany | 431/291 |
| 1322081 | 2/1963 | France | 431/290 |
| 195844 | 4/1923 | United Kingdom . | |
| 225380 | 12/1924 | United Kingdom . | |
| 245706 | 1/1926 | United Kingdom . | |
| 286897 | 3/1928 | United Kingdom . | |
| 695447 | 12/1953 | United Kingdom . | |
| 1269537 | 4/1972 | United Kingdom . | |
| 1421416 | 1/1976 | United Kingdom . | |
| 1438202 | 6/1976 | United Kingdom . | |
| 2115918 | 7/1985 | United Kingdom . | |

*Primary Examiner*—Margaret A. Focarino
*Attorney, Agent, or Firm*—Leydig, Voit & Mayer

[57] ABSTRACT

A candle in the form of a wax body with an embedded or replaceable wick is supported by a spring within a tubular outer casing which has a thermally-insulating lining. A thermally-insulating cover extends across the upper end of the tubular outer casing and the wick extends through an aperture in the cover. Thermally conducting wires extend from the aperture in the cover to conduct heat to the periphery of the candle body below the cover to ensure uniform melting of the wax which flows through apertures in the cover. As the candle burns the spring urges the candle body upwards towards the cover to maintain the burning wick at a generally constant height.

26 Claims, 5 Drawing Sheets

CANDLE DEVICE

This invention relates to a candle device and in particular to a candle device which will maintain the burning wick of a candle in a substantially constant position.

Candles are known comprising a wax body having an embedded wick. The candle burns from the top, the wax around the base of the exposed wick melting before it is burnt. It is also known to house a candle in a container and support the candle on a compressed spring. As the candle burns the spring expands and raises the candle, so that the top of the unburnt candle portion remains at a generally constant height.

The present invention provides in one aspect a candle device comprising a candle housed in a container, a cover comprising a thermally insulating plate located on top of the container and covering an upper surface of the candle, the plate having an aperture or slot through which a wick of the candle projects, means for urging the candle upwardly in the container and means for conducting heat from the region of the candle wick to beneath the cover.

With such an arrangement, a pool of molten wax can be formed on top of the cover around the burning wick of the candle, whilst the wax immediately below the wick is melted by the transfer of heat below the cover to form a reservoir the molten wax passing through the aperture in the cover to replenish the pool of wax above the cover as it is burnt. The cover may provide for more controlled melting of the candle across its top surface.

The means for conducting heat beneath the cover may comprise a coil of thermally conducting material, such as wire, which is provided in the aperture or slot and may serve also to support the candle wick. This is particularly applicable for candles of smaller diameter.

For larger diameter candles in particular the means for conducting heat may comprise thermally conducting elements which extend from the aperture or slot beneath the cover to the outer periphery of the candle.

Preferably a plurality of apertures or slots are provided to allow molten wax to flow from the reservoir to the pool above the plate.

Very preferably the cover has a dished lower and/or upper surface assisting the flow of molten wax from beneath plate and/or its collection around the candle wick.

The cover may comprise two layers, an upper layer of heat resistant material to resist the candle flame, for example of metal, glass or porcelain, and a lower layer of insulating material, for example of plastics. The cover may be formed of a high temperature thermostat resin which will withstand the candle flame and also be thermally insulating.

Preferably, the candle is contained in a flexible casing to retain molten wax and prevent sticking of the candle to the container wall.

In another aspect the invention provides a candle housed in a curved or bent tube, and means for urging the candle along the tube. The tube may be capped at one end by a thermally insulating cover as defined above.

Preferably, at least one sphere is provided at an end of the candle distal from the frame to facilitate movement around the bend of the tube. The sphere may be of wax so that it will burn. If desired, the candle itself may comprise a plurality of such spheres.

Means for heating the candle in the vicinity of the bend may comprise a thermally conducting wire extending down the side of the tube from the region of the candle wick.

The invention will be further described by way of example with reference to the accompanying drawings, in which.

Figure 1:
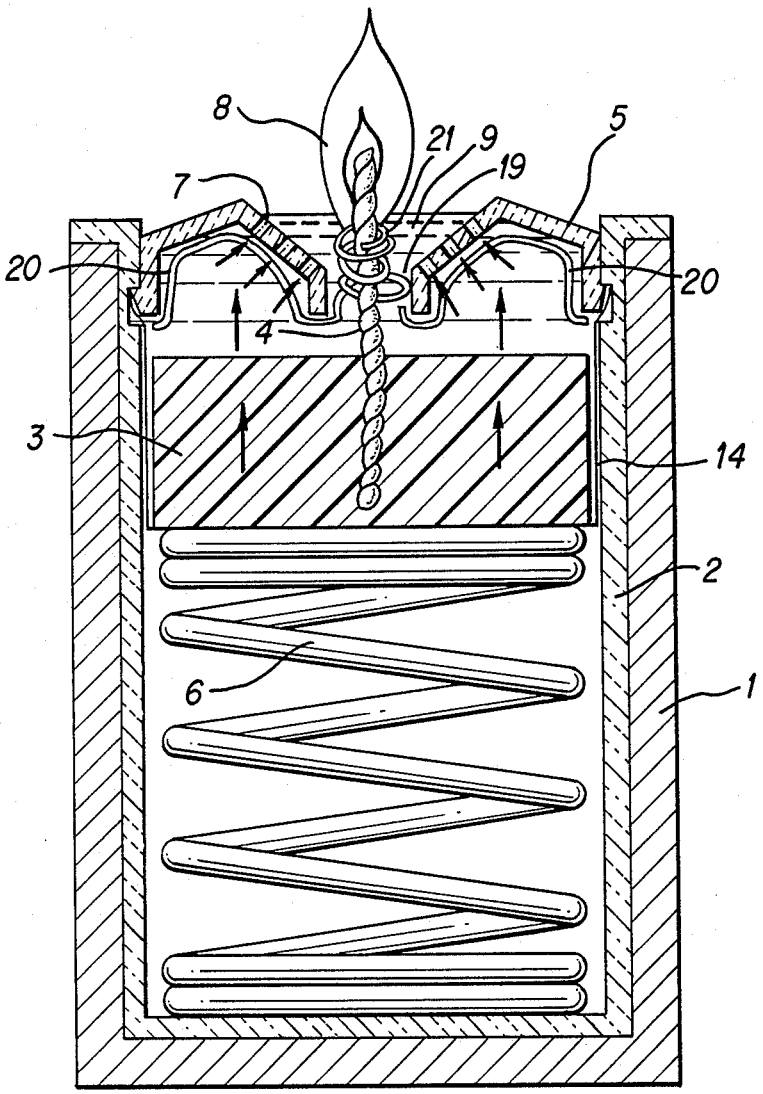
FIG. 1 is a sectional view of a first embodiment of the invention.

Referring firstly to FIG. 1 of the drawings, the candle device shown therein comprises a container in the form of a tubular outer casing 1 and an inner lining 2 of thermally-insulating material, a candle in the form of a wax body 3 with an embedded wick 4, an apertured thermally-insulating cover 5 extending across the upper end of the tubular outer casing 1 and a helical compression spring 6 within the casing 1 below the wax body 3.

The outer casing 1 can be formed of any appropriate material such as porcelain, plastics, marble, metal, glass, fibre, wood or cardboard and can be provided with a plain or decorative external surface. It could also be formed of wax.

The lining 2 fits snugly in the casing 1 and has a tubular sleeve portion with an integral base portion and an annular outwardly extending flange at its upper end which covers the uppermost edge of the casing. The flange is particularly important if the outer casing 1 is of wax as it will shield the top of the wax outer casing 1 from radiated heat. The lining 2 also has an internal annular groove near to its upper end for receiving the cover 5 as a snap fit. This ensures that the cover 5 will not accidentally become detached from the lining.

The wax body 3 is mounted within the lining 2 below cover 5 in an open-topped thin flexible casing 14 and is subjected to an upwardly directed force exerted by the compression spring 6. The casing 14 is preferably formed of cellulose or polyethylene film although it may, for instance, be of aluminum foil. The casing 14 is trapped between the cover 5 and base of the groove in the lining and retains the molten wax at the final burning stage of the wax body 3. It also serves to prevent sticking of the wax body 3 to the lining 2.

The cover 5 which is made of thermally insulating material such as a hard, high melting point thermoset resin material, comprises an inner funnel-shaped portion, an outer sleeve portion having an outwardly directed lip which is snap fittably received in the annular groove in the lining, and an intermediate portion extending between the inner and outer portions. The cover has a central aperture 19 through which the wick 4 extends and a plurality of other openings 7 through which molten wax can flow. The number of openings depends on the type of wax used for the body 3 and the diameter of the cover 5. Thermally conducting metal wires 20 extend from the aperture 19 to conduct heat to the periphery of the candle below the cover 5, to melt the wax across the full diameter of the candle. One of the wires 20 forms a conical coil 21 supporting the wick in the aperture 19.

For small diameter candles the coil 21 may be sufficient to conduct heat below the cover to melt the candle. For larger diameter candles it is preferred to use wires 20, it being preferably also to use a coil 21 to support the wick.

Slots, preferably extending radially from the centre, may be provided in place of or as well as a plurality of discrete apertures.

In use, as the candle burns, molten wax 9 is formed above the solid wax body 3. There is of course also a transition zone between the solid and molten wax where the wax is soft but not molten. The molten wax flows into the region defined by the funnel-shaped portion of the cover 5 via the opening or openings 7 to a level just below the uppermost part of the cover 5. As the wax burns the spring 6 relaxes and moves the body 3 upwards in such a manner that the surface level of the molten wax is maintained substantially constant. The flame extends above the open upper end of the casing 1, but wax does not flow over the casing 1.

The casing 1 of this candle device maintains its external appearance and can be used with replaceable wax bodies 3.

Figure 2:
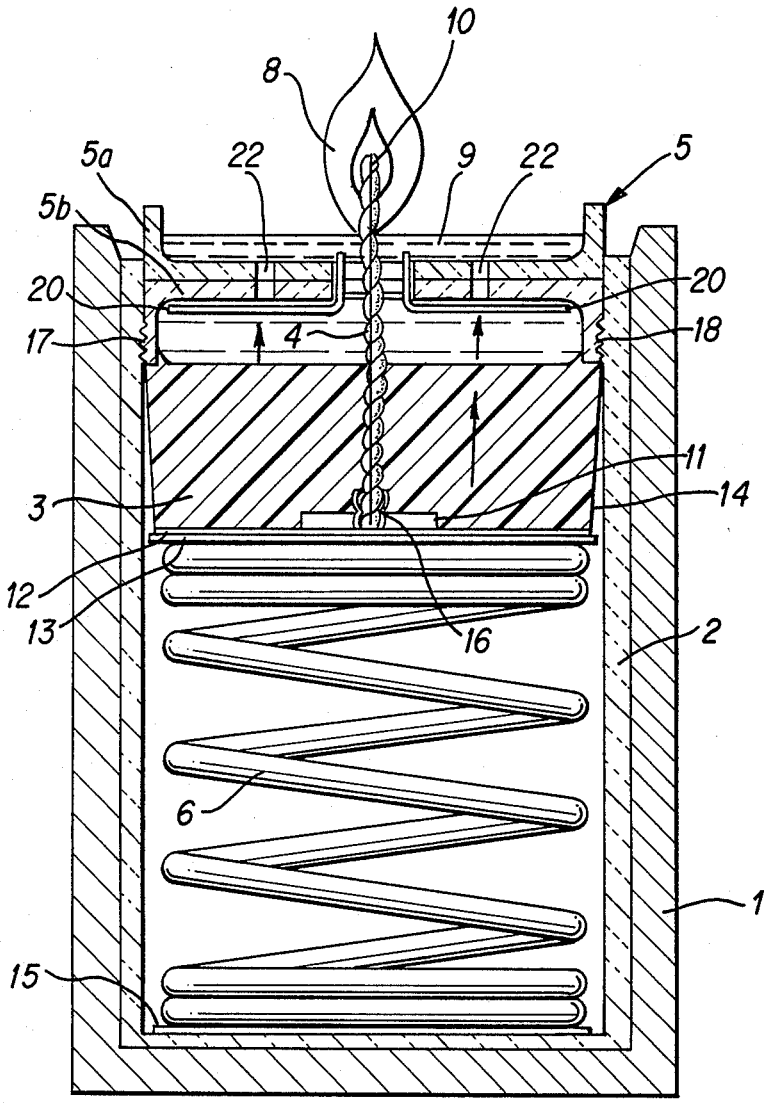
FIG. 2 is a sectional view of a second embodiment of the invention.

Referring now to FIG. 2 of the drawings, the candle device shown therein is generally similar to that shown in FIG. 1. However, the wax body 3 has a rigid base plate 12 attached to its lowermost end. The wick 4 whilst being embedded in the wax body 3 is attached to the centre of the plate 12 by means of a clip 16 on an apertured aluminium disc 11 to prevent sideways movement of the lower end of the wick when burning of the wax body 3 is nearly complete and a stiff support member 10, for example of bamboo fibre, is provided within the wick 4 to keep the latter upright.

The wax body 3 and base plate 12 are contained in an open-topped thin flexible casing 14, similar to that described in relation to the embodiment of FIG. 1. Circular plates 13 and 15 are provided between the upper end of the spring 6 and the flexible casing 14 and between the lower end of the spring 6 and the lining 2, respectively, to protect the thin casing 14 and lining from damage by the spring and to ensure that the force of the spring 6 is applied uniformly to the base of the wax body 3.

The thermally insulating cover 5 differs from that of the embodiment shown in FIG. 1 in that the radially inner portion in this case is a flat apertured member and the radially outer portion is a cylindrical, upwardly extending rim attached to the inner portion. Moreover, the rim has an external screw thread 17 which screw threadably cooperates with an internal thread 18 on the lining 2 to clamp the upper end of the thin casing 14.

The cover comprises an upper section **5*a* of flame resistant material, such as metal or porcelain, on a lower section 5*b* of thermally insulating material, such as plastics, wood, or multi-ply paper. The covers illustrated in FIGS. 1 and 3** may be of the same construction.

The spring 6 of either of the above described embodiments could be replaced by any other appropriate device for moving the candle towards the upper end of the casing. Examples of alternatives to the spring 6 are described hereinafter with reference to FIGS. 6 and 7.

Thermally conducting wires 20 extend from the region of the flame 8 underneath the cover 5 as in the embodiment of FIG. 1.

Apertures 22 in the cover 5 allow molten wax to pass from beneath the cover to the surface. Additional wicks may be provided, extending through the apertures 22, which may be widened for this purpose. Also the support memvber 10 may be replaced by or supplemented with coil 21 as in FIG. 1.

Figure 3:
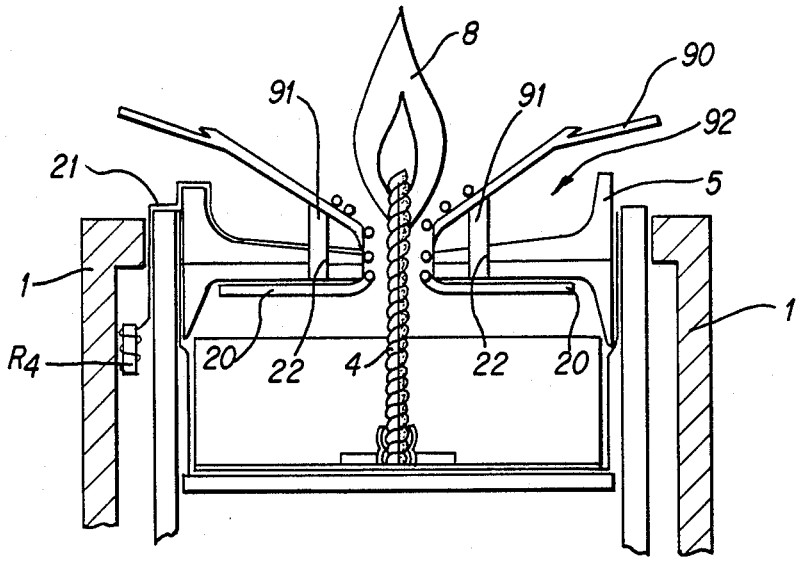
FIG. 3 shows a modification of the embodiment of FIG. 2.

In the modification shown in FIG. 3 a heat shield (and heat sink) 90 is supported on the cover 5 by posts 91 which penetrate apertures 22. A gap 92 is provided between the shield 90 and the cover 5 to allow convection of heat therefrom. The heat shield 90 may be of metal or of laminated construction with a metal upper layer and thermally insulating lower layer. In any event posts 91 should be of thermally insulating material. The shield 90 may be of any appropriate shape, but in a preferred embodiment is in the shape of petals of a flower to enhance the appearance of the product. The upper surface of the shield 90 could be coated with a temperature sensitive material which changes colour as its temperature rises. The shield 90, in addition to enhancing the appearance of the product, shields the outer casing 1 from heat radiated fromthe flame 8. This is particularly important if the casing 1 is of wax.

Figure 4:
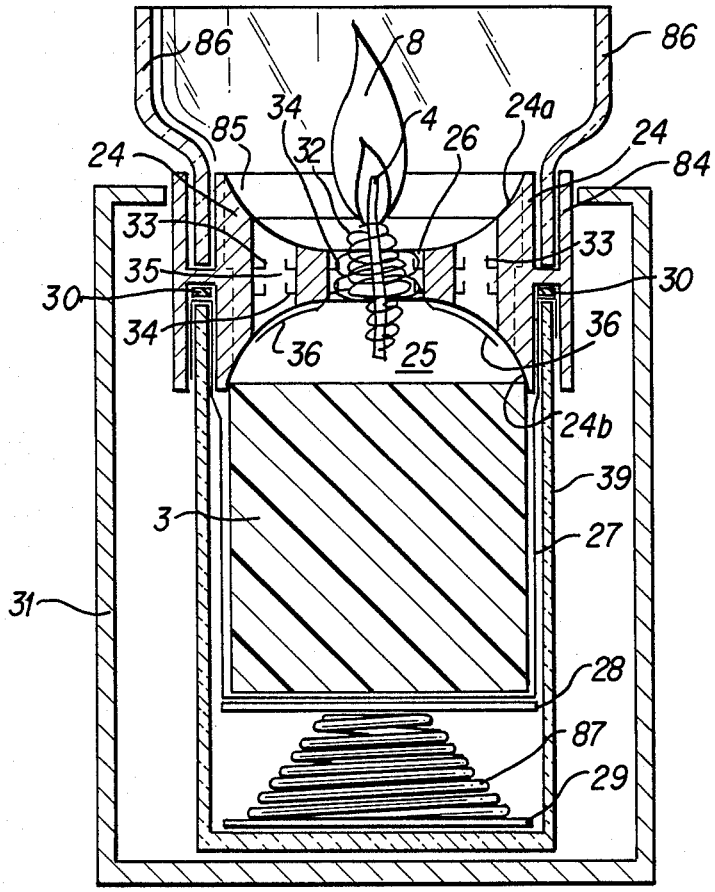
FIG. 4 is a sectional view of a third embodiment of the invention.

FIG. 4 shows a third embodiment in which a cover plate 24 has dished upper and lower surfaces **24*a*, 24*b* of generally hemispherical shape. The upper surface 24*a* ensures that molten wax collects in the centre around the candle flame 8, and the lower surface 24*b* guides the molten wax 25 up through the central aperture 26. The cover 24 has an H-shaped cross section at its outer edge, the downwardly pointing legs of the H enclosing the sides of a container 39 which houses a spring, shown schematically at 87, and a candle body 3 at its upper end. The candle body 3 is enclosed in a thin flexible casing 27 as in the previous embodiments and is supported by a plate 28 on top of the spring, so as to move upwardly as described previously in connection with FIG. 2. A plate 29 is positioned beneath the spring 27**.

An annular seal 30, of rubber or fibre or the like, is positioned at the top of the inner container 39 to prevent molten wax seeping out past the legs of the cover 24.

A decorative outer casing 31 surrounds the device.

The cover 24 has a conical coil 32 supporting a wick 4. The coil is supported by metal hooks 34 set in the wall of the aperture 26.

Figure 5:
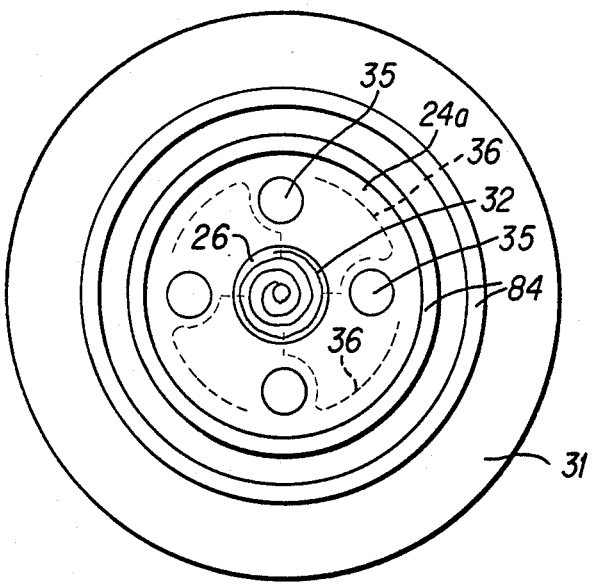
FIG. 5 is a partial plan view of the cover of FIG. 4.

As seen in FIG. 5, a plurality of outer apertures 35 is provided. These may each support a coil 32 to enhance the conducting properties of the central coil, or some fireworks (not shown in FIG. 4) on hooks 33. Further wicks 32 could be provided in the coils in the outer apertures 35.

The cover 24 may be formed of upper and lower sections similar to that shown and described with reference to the embodiment of FIG. 2. In this case the lower section is conveniently of multi-ply paper in order to support the hooks 33 and 34.

FIG. 5 shows the path of thermally conducting wires 36 which extend below the cover, under the surface 24b to conduct heat from around the flame 8 to the outer edges of the candle.

The coil 32 may take on a number of shapes, for example, generally cylindrical, an inverted cone shape with the upper end spiralling inwardly in a plane to support the wick at its centre, or a double cone shape tapering to its upper and lower ends.

The H shape cross-section outer rim 84 may be formed separately to the inner dished portion 85, the inner dished portion sitting within the rim as indicated by the dotted lines in FIG. 4. The rim serves to protect the upper edge of the outer casing 31.

The container 39 is preferably of thermally insulating material.

The thin flexible casing 27 is preferably sandwiched between a limb of H-shape cross-section and the container 39.

As the candle melts and is raised the casing 27 compresses in concertina fashion (see FIG. 2). The casing serves, as mentioned previously, to retain the molten wax and is particularly useful towards the end of the candle life, holding a pool of molten wax beneath the cover 24.

In place of a wick embedded in the wax body, a replaceable wick is shown, the wick being supported in the coil 32. Indeed such a replaceable wick may be used with any of the embodiments described herein.

The H-shape cross-section rim is particularly useful for small diameter candles to protect the outer casing 31.

A support 86, preferably of transparent material, e.g. glass, may be located between the upper limbs of the H-shape cross-section rim to support a glass cover (not shown). The support 86 is omitted from FIG. 5 for clarity.

The means for urging the candle upwardly may take a number of forms.

Figure 6:
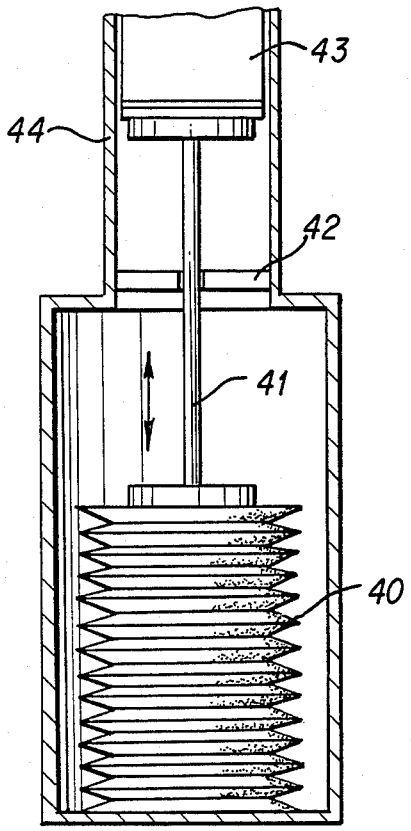
FIG. 6 is a schematic sectional view of a part of yet another embodiment of the invention.

FIG. 6 shows a bellows 40 which is filled with compressed air and supports a plunger 41 which slides in a collar 42 and supports a candle body 43 in a thin flexible casing (not shown). The upper end of the candle body 43 and container 44 are capped by a cover as described in previous embodiments.

As the candle wax is burnt the bellows expands to urge the candle up. A fixed amount of air may be kept in the bellows.

Figure 7:
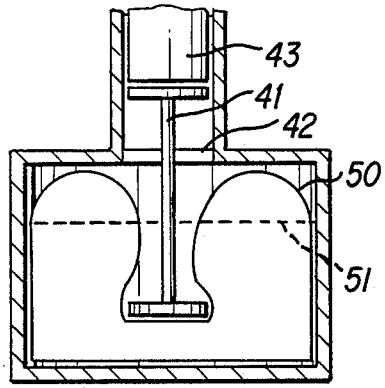
FIG. 7 shows a modification of the embodiment of FIG. 6.

FIG. 7 shows an arrangement in which a flexible elastic diaphragm 50 supports the bottom of plunger. A fixed plurality of liquid is contained beneath the diaphragm. As the candle body 43 burns the diaphragm relaxes, returning eventually to a planar condition at line 51, the liquid displaced by the plunger 41 being raised above line 51 to counter the weight of the plunger and candle as a candle is placed on the plunger.

Figure 8:
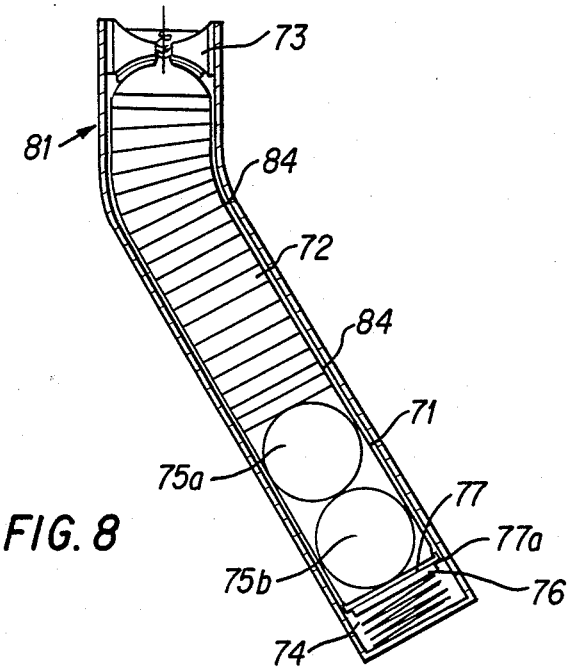
FIG. 8 is a cross-section showing yet another embodiment of the invention.

FIG. 8 shows another embodiment of the invention. A bent tube 71 houses a candle which is in short cylindrical segments 72. Tube 71 may be of any suitable material, such as metal, plastics, porcelain, cardboard.

The tube 71 is capped by a cover 73 similar to that described previously in connection with anyone of the preceding embodiments. However, the cover as shown is similar to that described in connection with the embodiment of FIG. 3 but a single aperture is illustrated. A single aperture is found suitable for candles of smaller diameter. For larger diameters a plurality of apertures, or a radially extending slot or slots may be provided.

A spring 74 bears on two spheres **75*a* and 75*b* via plate 76 and. Plate 77 has a cylindrical flange 77*a* extending around its peripheral edge to guide the plate 77 along the length of the tube 71 and maintain the plate 77 in a plane which is substantially perpendicular to the longitudinal extent of the tube 71** to prevent jamming.

The plate 76 is in the form of a flat disc which fits within the flange **77*a* of the plate 77** to reinforce the latter.

The sphere **75*a* could be of wax. The candle 72 is contained in an open-topped flexible casing 84, similar to that previously described. In fact, the spheres 75*a* and 75*b* may also be contained, as shown, within the casing 84 and if the sphere 75*a* is of wax this latter sphere should in any event be contained within the casing 84**.

The spheres 75 will pass around the bend, transmitting the force of the spring 74, without the spring having to turn the bend.

For a larger bend, or greater distance above the bend more spheres may be used.

To facilitate insertion of the candle the tube 71 may be formed in two parts joined at the bend 81, for example by a screw fitting or bayonet connection.

Figure 9:
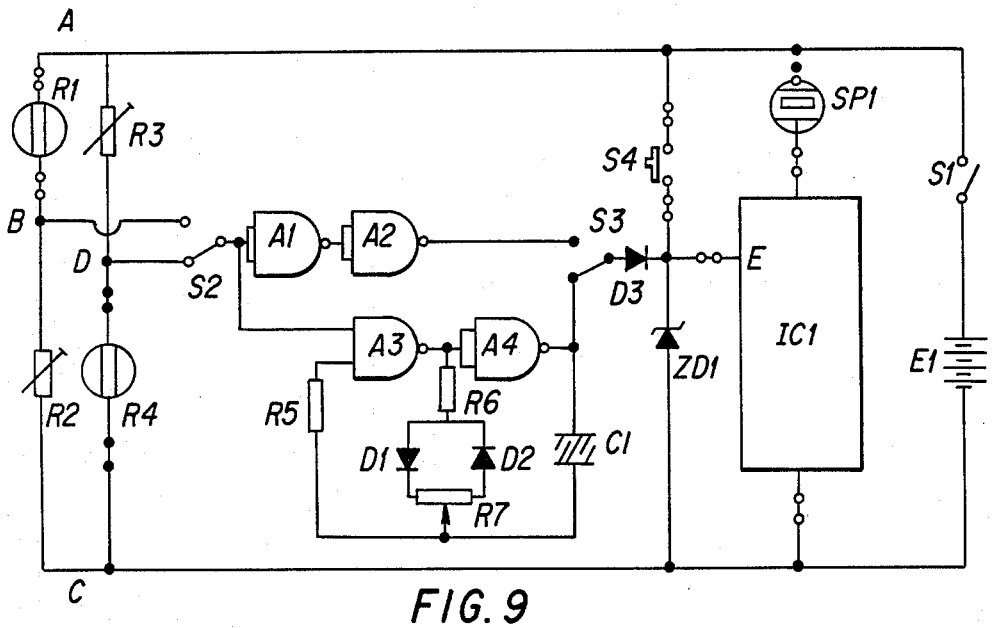
FIG. 9 is a circuit diagram of an optional musical feature.

Referring to FIG. 9, a music generating circuit shown therein comprises a first pair of logic gates A1, A2 and a second pair of logic gates A3, A4 in the form of an integrated circuit. Gates A3 and A4, together with resistors R5, R6 and R7, diodes D1 and D2, and capacitor C1, constitute an astable multivibrator to provide an output timing control signal.

Resistors R1 to R4 are connected as a bridge ABCD. Terminals A and C of the bridge are connected in series with a switch S1 and a battery E1. Terminals B and D are selectively connected to the input terminals of gates A1 and A3 by a switch S2.

Integrated circuit IC1 is a memory storing one or more segments of music. It is connected in series with a piezo-electric crystal speaker SP1 across battery E1 and the switch S1. By applying an appropriate electrical signal to a terminal E of the integrated circuit IC1, the latter will be triggered to provide an electrical output signal corresponding to a segment of music to drive the speaker SP1.

The electrical signal applied to the terminal E is selectively provided by gate A2 or gate A4 through a switch S3 and a coupling diode D3.

A zener diode ZD1 is connected between the terminal E and the negative terminal of the battery E1 to limit the magnitude of the electrical signal applied to the terminal E. Pushbutton switch S4 is connected between the terminal E and the positive terminal of the battery E1 via the switch S1. The operation of the integrated circuit IC1 may be tested by applying an electrical signal to the terminal E thereof using the switch S4.

Resistors R1 and R4 are photo-sensitive and thermo-sensitive, respectively. As ambient lighting conditions and temperature change, their resistive values will vary with the result that the voltage applied to gates A1 and A3 will change. Switch S2 is used to select light sensitive or temperature sensitive operation of the circuit.

The circuit may be operated either to provide interrupted or continuous music. With the switch S3 in the position shown interrupted music will be provided by the astable multivibrator comprising gates A3 and A4. Continuous music can be provided by placing the switch S3 in its alternative position to by-pass the timing circuit.

The switch S1, when open, disables the music playing feature of the candle device. The above described music generating circuit can be used in conjunction with anyone of the embodiments of FIG. 1–9. FIG. 3, for example, shows the thermo-sensitive resistor R4 mounted within the outer casing 1. The temperature of the flame may be sensed by connecting the resistor R4 to the thermally conducting wires 20 using another thermally conducting wire 21. The photo-sensitive resistor R1 may be mounted on the outer surface of the outer casing 1 to sense ambient light. This remaining of the music generating circuit may be provided on a PCB disposed in an openable compartment at the lower end of the candle device.

Various modifications will be apparent to those skilled in the art and it is desired to include all such modifications as fall within the scope of the accompanying claims.

What I claim is:

1. A candle device comprising a candle housed in a container, a cover comprising a thermally insulating plate located on top of the container and covering an upper surface of the candle, the plate having an aperture or slot through which a wick of the candle projects, means for urging the candle upwardly in the container and means for conducting heat from the region of the candle wick to beneath the cover.

2. A device as claimed in claim 1, having a coil for supporting the candle wick and for conducting heat from the region of the candle wick.

3. A device as claimed in claim 2, wherein the coil is of thermally conducting material, such as metal wire.

4. A device as claimed in claim 2, wherein the coil is supported on hooks embedded in a wall of the aperture or slot.

5. A device as claimed in claim 1, wherein the means for conducting heat comprises at least one wire extending from the aperture or slot to the peripheral region of the candle beneath the cover.

6. A device as claimed in claim 1, wherein the cover comprises a plurality of apertures for the passage of molten wax from beneath the cover to above it.

7. A device as claimed in claim 1, wherein the upper surface of the cover is dished so that molten wax collects about the candle wick.

8. A device as claimed in claim 1, wherein the lower surface of the cover is dished to direct molten wax from beneath the cover to the wick.

9. A device as claimed in claim 1, wherein the cover comprises an upper layer of flame resistant material and a lower layer of thermally insulating material.

10. A device as claimed in claim 1, wherein the urging means comprises a spring.

11. A device as claimed in claim 1, wherein the urging means comprises a sealed bellows supporting the candle.

12. A device as claimed in claim 1, wherein the urging means comprises a flexible elastic diaphragm, the candle being supported on one side of the diaphragm and substantially incompressible fluid being held on the other side of the diaphragm.

13. A device as claimed in claim 1, wherein the candle is contained in a flexible casing.

14. a device as claimed in claim 1, wherein the container comprises an outer casing and an inner liner.

15. A device as claimed in claim 1, wherein the candle has a replaceable wick.

16. A device as claimed in claim 1, wherein a heat shield is supported on the cover.

17. A device as claimed in claim 16, wherein the upper surface of the heat shield is coated with a temperature sensitive material which changes colour as its temperature rises.

18. A device as claimed in claim 1, wherein the container is bent or curved.

19. A candle device as claimed in claim 1 wherein the container is a bent or curved tube.

20. A device as claimed in claim 19, wherein at least one sphere is provided within the tube at an end of the candle distal of the flame.

21. A device as claimed in claim 19, wherein the means for urging the candle along the tube comprises a spring disposed between an end of the tube and an end of the candle distal from the flame.

22. A device as claimed in claim 19, wherein the candle comprises a plurality of cylindrical segments.

23. A candle device as claimed in claim 1, in combination with a music generator.

24. A candle device as claimed in claim 23, wherein the music generator includes a thermo-sensitive element for operating the generator when the temperature sensed by the thermo-sensitive element exceeds a predetermined value.

25. A device as claimed in claim 24, wherein the thermo-sensitive element is thermally connected to the means for conducting heat from the region of the candle wick to beneath the cover by an elongate thermally conducting member.

26. A candle device as claimed in claim 23, wherein the music generator includes a photo-sensitive element for operating the generator when the light sensed by the photo-sensitive element exceeds a predetermined value.

* * * * *